US011229303B2

(12) United States Patent
Toben

(10) Patent No.: US 11,229,303 B2
(45) Date of Patent: Jan. 25, 2022

(54) MODULAR, MULTI-FUNCTION FRAME SYSTEM

(71) Applicant: MYFRAMEZ, LLC, Phoenix, AZ (US)

(72) Inventor: John Toben, Phoenix, AZ (US)

( * ) Notice: Subject to any disclaimer, the term of this patent is extended or adjusted under 35 U.S.C. 154(b) by 73 days.

(21) Appl. No.: 16/725,542

(22) Filed: Dec. 23, 2019

(65) Prior Publication Data

US 2020/0196777 A1 Jun. 25, 2020

Related U.S. Application Data

(60) Provisional application No. 62/783,575, filed on Dec. 21, 2018.

(51) Int. Cl.
*A47G 1/06* (2006.01)

(52) U.S. Cl.
CPC ..... *A47G 1/06* (2013.01); *A47G 2001/0672* (2013.01); *A47G 2001/0694* (2013.01)

(58) Field of Classification Search
CPC ..... A47G 1/06; A47G 2001/0694; A47G 2001/0672; A47G 1/142; A47G 21/14; A47G 1/17; G09F 1/12; F16B 2001/0035; F16B 47/00
USPC ..... 248/467, 229.1, 472, 473
See application file for complete search history.

(56) References Cited

U.S. PATENT DOCUMENTS

| | | | | |
|---|---|---|---|---|
| 3,456,374 A * | 7/1969 | Baermann | G03D 15/10 40/701 |
| 7,437,846 B2 * | 10/2008 | Franco | A47G 1/065 206/449 |
| 2003/0121193 A1 * | 7/2003 | Kim | A47G 1/06 40/711 |
| 2009/0100732 A1 * | 4/2009 | Seidler | A47G 1/065 40/729 |
| 2010/0024271 A1 * | 2/2010 | Seidler | A47F 7/147 40/711 |
| 2010/0083548 A1 * | 4/2010 | Reis | A47G 1/142 40/711 |

FOREIGN PATENT DOCUMENTS

DE 202004006862 U1 * 12/2004 ..... A47G 1/17

* cited by examiner

*Primary Examiner* — Cassandra Davis
(74) *Attorney, Agent, or Firm* — David G. Henry, Sr.; Alexander B. Uber; Gray Reedf

(57) ABSTRACT

A modular frame system with constituent components that are magnetically attached and detachable, and with a multi-ply construction facilitating cooperative forming of useful recesses and enclosures.

3 Claims, 6 Drawing Sheets

MODULAR, MULTI-FUNCTION FRAME SYSTEM

STATEMENT OF PRIORITY

The present application claims priority to U.S. Provisional Application No. 62/783,575, titled "Modular, Multi-Function Frame System" and filed on Dec. 21, 2018.

BACKGROUND OF THE INVENTION

Field of The Invention

The present invention relates to frame assemblies for housing and display of photographs and two dimensional art or other graphics.

Background of the Invention

Frames have adorned and, in some cases protected mostly two-dimensional artwork (painted landscapes, still life, portraits) for hundreds of years, and the use of frames extended to photographs in the late $19^{th}$ century.

Perhaps through most of history that involves framing, the frames were primarily ornamental, such as in the case of elaborate gold leaf frames that one might find framing the finest paintings in the world's various fine art museums. In some other contexts, however, frames have served primarily as of means of preservation. This is true, especially in the instance of photographs, in which a plain or simplistic frames with little aesthetic qualities serves almost solely for supporting a layer of glass that overlain the photograph to protect it. In still other, mostly modern times contexts, some frames both adorned and protected their encased artwork or photographs.

It is the latter vein in which there remain voids in the marketplace in satisfying consumers' ever-increasing desire for customized and personalized adornments for their respective dwelling and/or work spaces. Furthermore, there remains an absence in providing frames that are, at the same time, aesthetically pleasing as well as flexible with respect to orientation, display mode (wall-mount or tabletop, for example), ease of use, and changing of framed content. Further still, there is nothing known to address all of the foregoing considerations, while also providing a physical frame design that is entertaining to use and change.

SUMMARY OF THE INVENTION

In view of the foregoing, it would be advantageous to consumers of frames for two-dimensional media to provide a framing system that is more easily adaptable and interchangeable between wall and surface mount display and support modes.

It would be further advantageous at least to provide a framing system that is economically and easily adaptable with respect to its aesthetic features.

The present inventors here disclose a novel and unobvious apparatus and associated method for use in framing two dimensional artwork or photographs that meet at least each of the preceding objectives.

The apparatus of the present invention is an assembly that includes reversibly-attachable, magnetically-engaged components. A face frame component has an aperture for visualization of the encased piece.

A back plate, not only serves as the traditional backing for the encased piece, but, on its rearward face, has a speciallyshaped aperture for, among other things, accommodating the reversible attachment legs in variously provided locations for enabling differing orientations when table-top display is desired. This same aperture (in the preferred embodiment) forms apices for centering the plate about a nail or hanger, when the assembly is wall-mounted.

Within the bounds of the back plate aperture are applied indicia that correspond to the "footprint" of attachment faces of removable "legs" that support the assembled frame in alternative respective orientations associated with the indicia. Within each indicia (essentially and outline of the leg's attachment face) are, in the preferred embodiment, two magnets. These magnets are positioned within the bounds of the indicia such that, when the attachment face of a leg is aligned within the indicia, complimentarily-positioned magnets on the attachment face magnetically bind the leg to the back plate in the desired location.

As with the legs' attachment to the backplate, all components of the frame assembly are, in the preferred embodiment, reversibly, magnetically joined as shown in the accompanying diagrams.

With respect to the basic frame function; the magnetic joinder of the face frame to the back plate permits very easy placement and subsequent changing of the encased piece. Furthermore, however, such modularity also allows the easy and enjoyable substitution of alternative face frames each with, for example, differing aesthetic features, all while using a single back plate.

In retailing such a system, a single back plate could be sold separately, with the purchaser choosing from among a variety of face frames, or "kits" with a single back plate and several face frames could be assembled.

A still further example of the beneficial nature of the construction mode of the present frame system is embodied in the preferred embodiment's inclusion of a hanging nail and a hanging screw in an enclosure formed by a recess in the back plate, and occluded by the face frame when the frame assembly is complete. Such an arrangement would be impractical in conventional frames, both with respect to space, but even more so with respect to easy access. In the present case, accessing the provided nail or screw is as simple as pulling the face frame and back plate apart, and then "snapping" them back together after retrieving the nail or screw. It should be noted that, for embodiments of the present frame system that include such an accessory enclosure, fingerhold space is formed between the face frame's rearward face and the back plate (accessible through the back plates primary aperture) to allow for ease of "pulling apart" the two components to access the accessory enclosure.

DETAILED DESCRIPTION OF A PREFERRED EMBODIMENT

Figure 1:
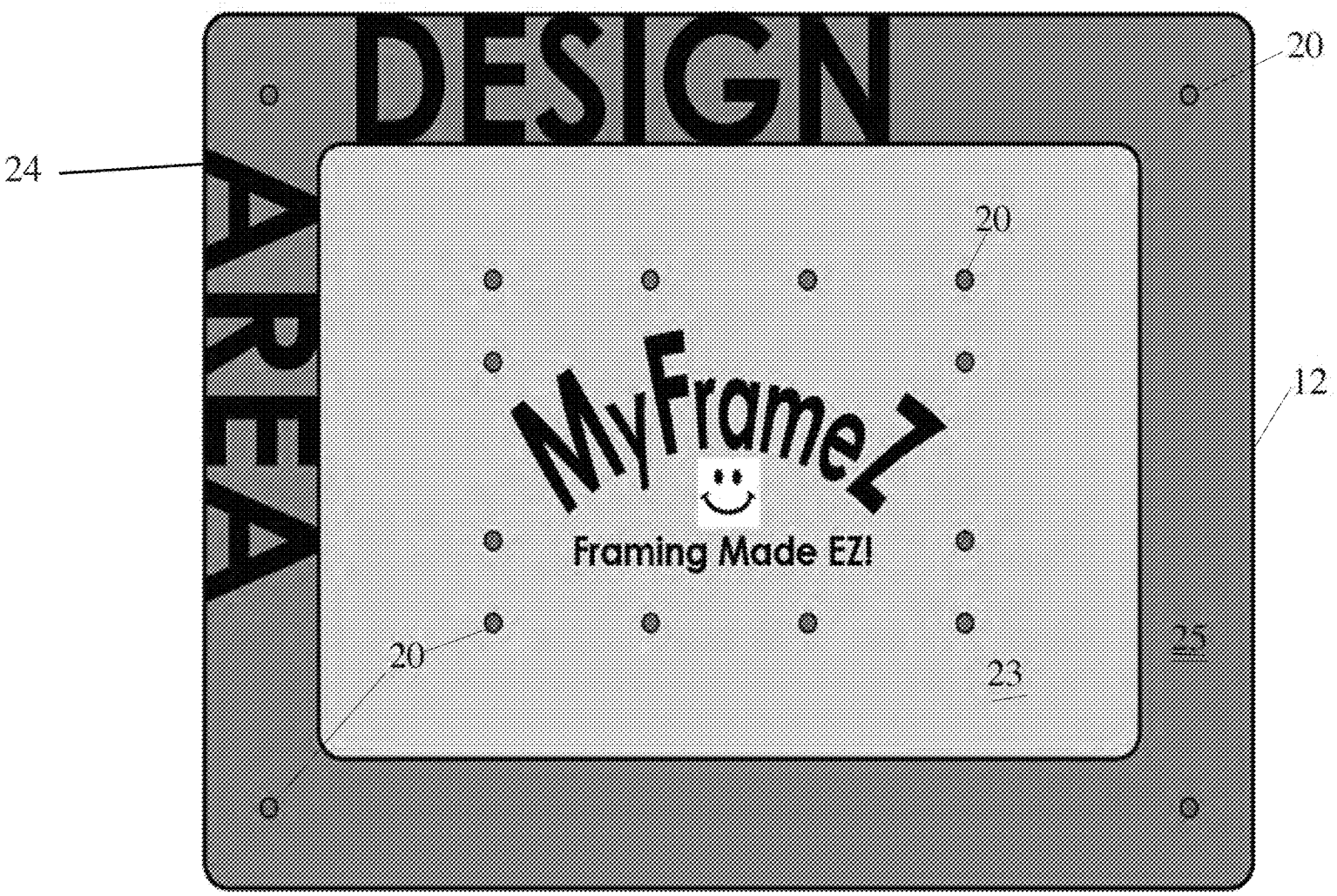
FIG. 1 depicts the front assembly of the present frame system.
Figure 2:
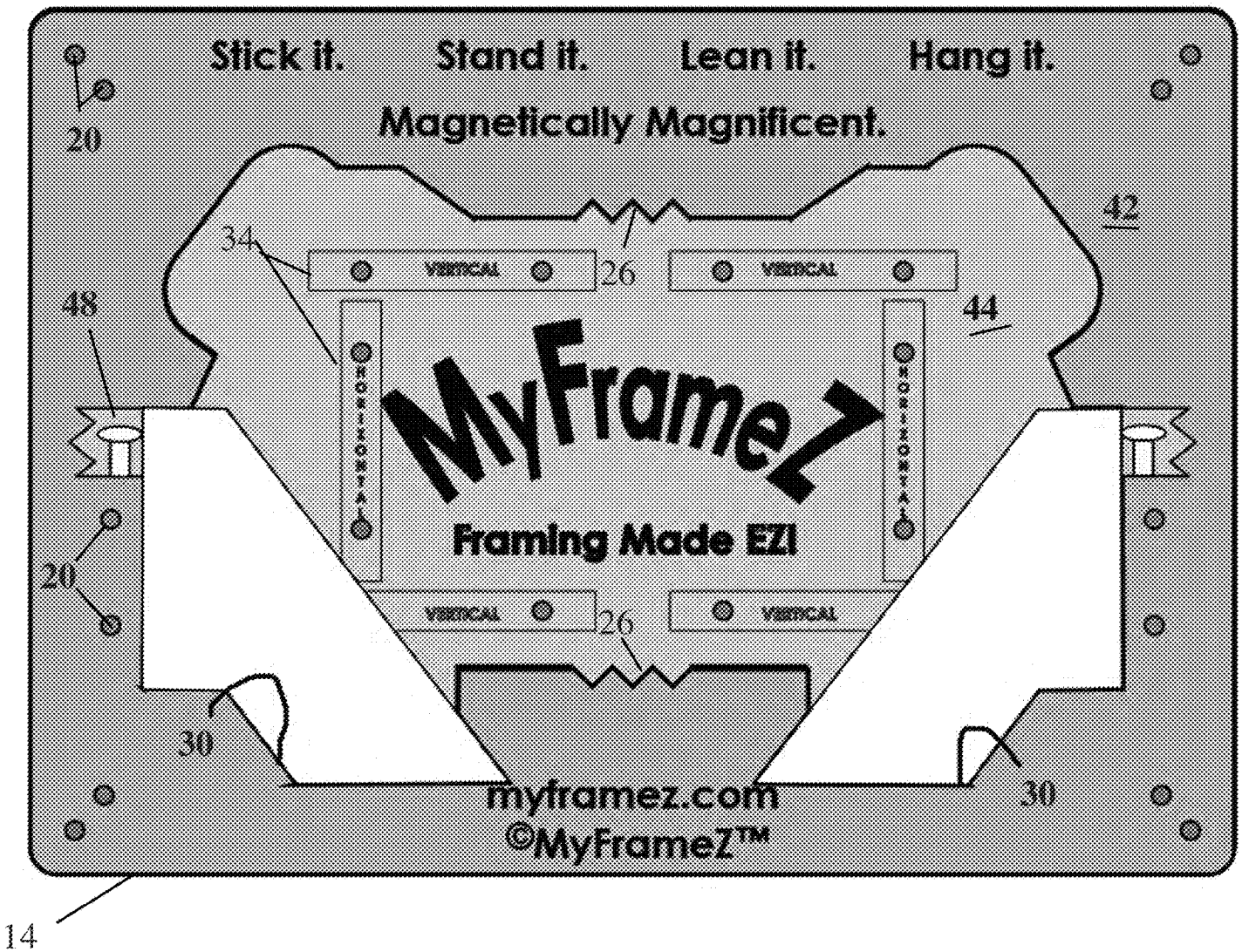
FIG. 2 depicts the rear assembly of the present frame system.

Referring to FIGS. 1-6, the modular, multi-function frame system of the present invention is identified generally by the reference number 10. Though other undepicted assemblages may be made by those using the present system, a preferred embodiment includes, a macro level, a face frame component 12, a back frame component 14, a protective lens layer (that may be of glass, acrylic, or any other transparent or translucent material), and foot/feet 28.

Strong magnets 20 (small, "button," rare earth magnets are preferred) are appropriately oriented, embedded throughout most components of system 10 and serve to allow the systems rapid and near effortless detachment, arrangement and re-attachment according to a user's desires. Orientation of magnets 20 are to be such that the components may be reversibly secured in (among others) the various configurations depicted, for example, in FIGS. 1 and 2. Appropriately orienting magnets 20 (about their respective "north" and "sound" poles for appropriate attraction, versus repulsion) during manufacture is well within the scope of basic skills of anyone involved in such an assembly.

Face frame component 12 includes a plurality of magnets 20 for reversibly securing to back frame component 14, with a protective lens layer secured therebetween (not separately shown in the drawings). A visualization aperture 22 is formed in layer(s) of face frame component 12 to allow front visualization of a photograph of other items placed for view (not separately shown in the drawings) within system 10. In most cases, an inner-most layer 23 of face frame component 12 will not have such an aperture.

Figure 5:
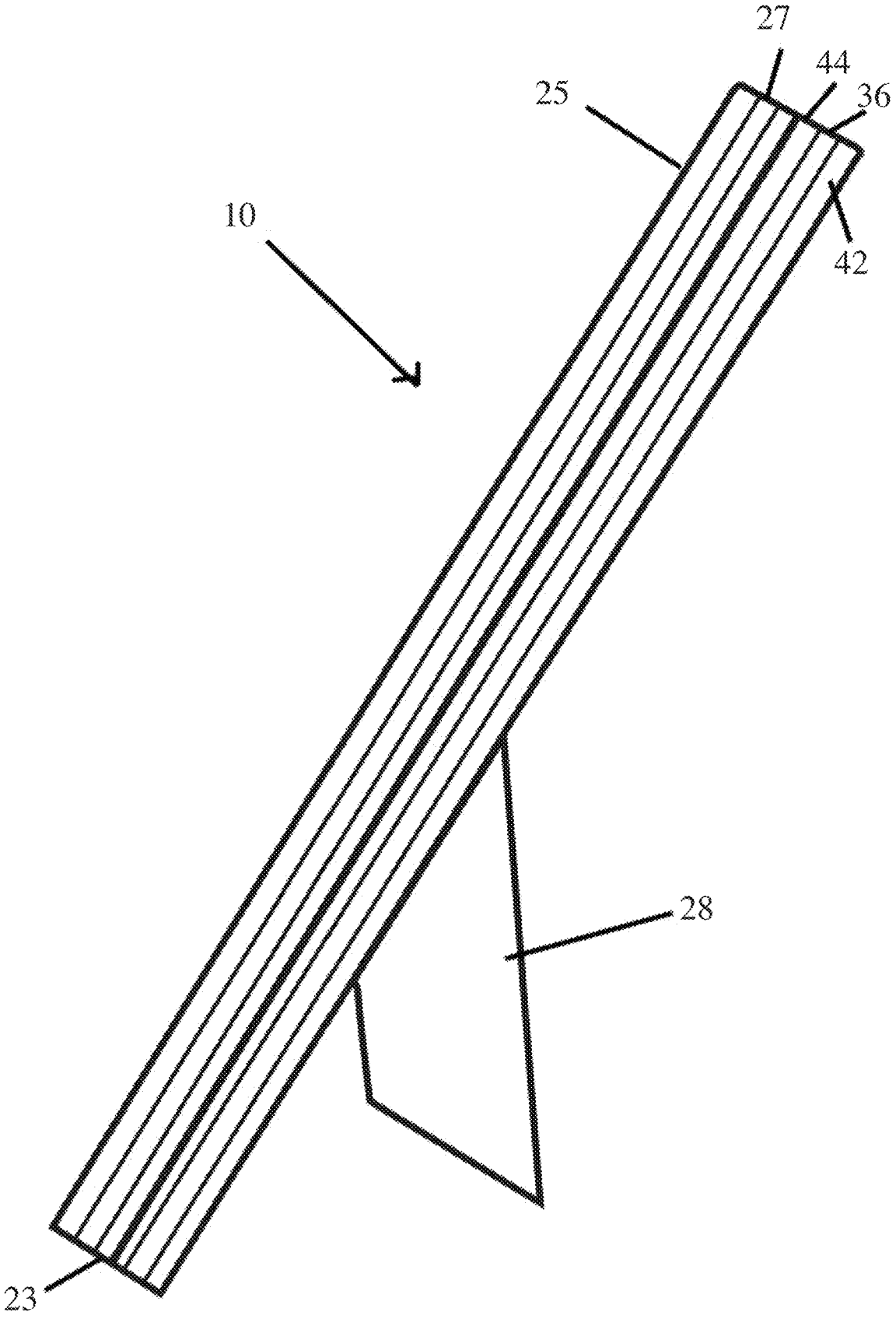
FIG. 5 depicts a side view of an assembly of the elements described in FIG. 1.

As particularly depicted in FIG. 5, in a preferred embodiment, face frame component 12 is (as is back frame component 14) a multi-ply assemblage of layers. In the case of face frame component 12, the primary purpose of such a construction is to allow for "3D" depiction of indicia or other design elements 24 configured as cut-outs in the front-most layer 25, with an appropriately finished medial layer 27 "showing through" (the example in FIG. 2 being shown as the letters "DESIGN AREA").

In the case of back frame component 14, the primary purpose of the multi-ply construction is more multi-faceted. It: (1) allows for nesting of components to optionally present a substantially "flat" facial contour; (2) allows for the definition of internal voids for storing such things as nails or hanging brackets; and (3) allows for contouring of rearward-most margins to form integral hanging nail or bracket interfaces 26.

Figure 4:
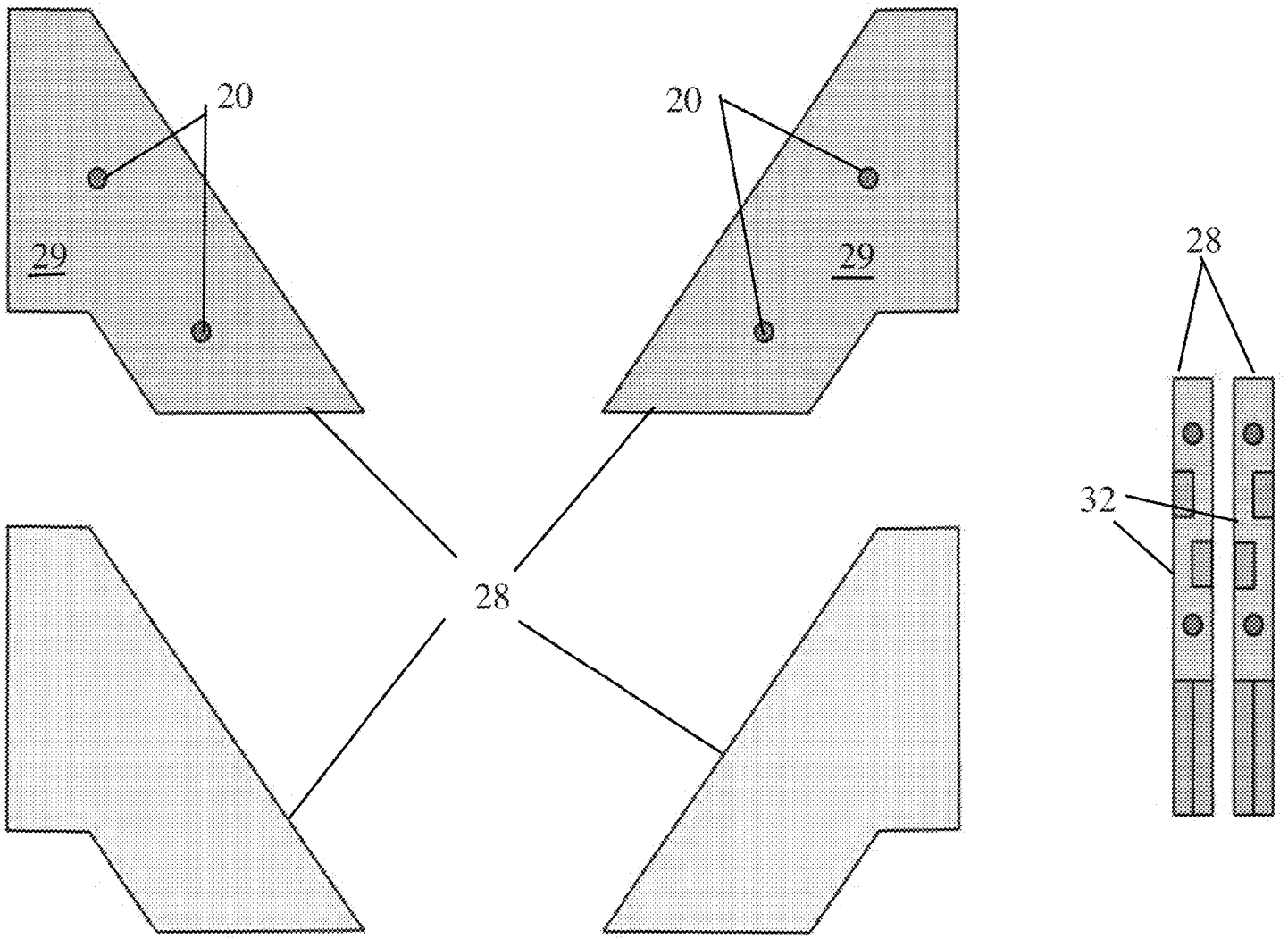
FIG. 4 depicts front, rear and end views of the detachable frame assembly feet.

Referring particularly to FIG. 4, detachable feet 28 are, in one configuration, nested within recesses 30 formed in rearward layer(s) of back frame component 14, when the system is in the aforementioned "flat" configuration. Magnets 20 are respectively embedded and positioned on feet 28 (on inner feet face 29) and in opposing layer(s) (layer 44) of back frame component 14 to reversibly secure feet 28 in their respective, nested positions within recesses 30. Additional magnets 20 are embedded in attachment faces 32 of feet 28, with corresponding magnets 20 embedded in layer (s) of back frame component 14 (such as those depicted in FIG. 1 within guidance boundary indicia 34, with the "VERTICAL" and "HORIZONTAL" indicia, as exemplifying instructive indicia for users in a preferred embodiment of system 10).

When feet 28 are to be used for supporting system 10 in a table-top-like display, they are detached from their nested positions within recesses 30, and are preferably attached as indicated in the aforementioned.

Figure 3:
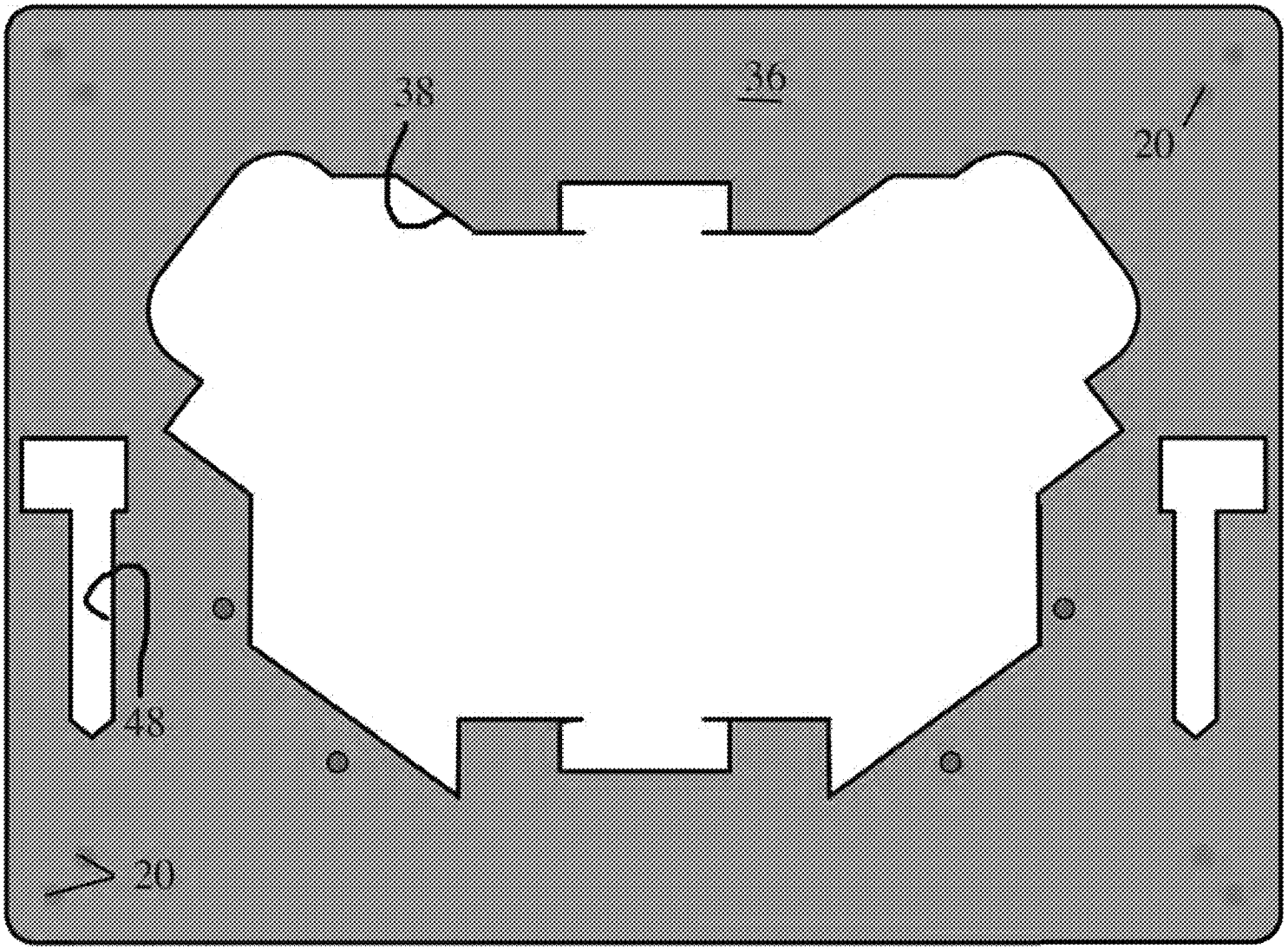
FIG. 3 depicts a medial layer of the back frame component of the present system.

Referring particularly to FIG. 3, medial layer 36 of back frame component 14 is separately depicted to illustrate the manner in which, in the case of back frame component 14, and in combination of other layers of back frame component 14, the multi-ply construction facilitates the aforementioned objectives of back frame component 14. Medial layer 36 defines a cut-out 38 that partially corresponds to a cutout in the rearward-most layer 42 of back frame component 14. Inner-most layer 44 of back frame component 14 serves as a foundational element that, ordinarily, has no cut-outs, excepts for those accommodating magnets 20 as depicted.

An exemplary, auxiliary cut-out 48, "floored" by inner-most layer 44, and partially over-lain by rearward-most layer 42, defines a partial enclosure in which hanging nails may be ensconced, but may be easily removed by detaching rearward-most layer 42 from medial layer 36.

Figure 6:
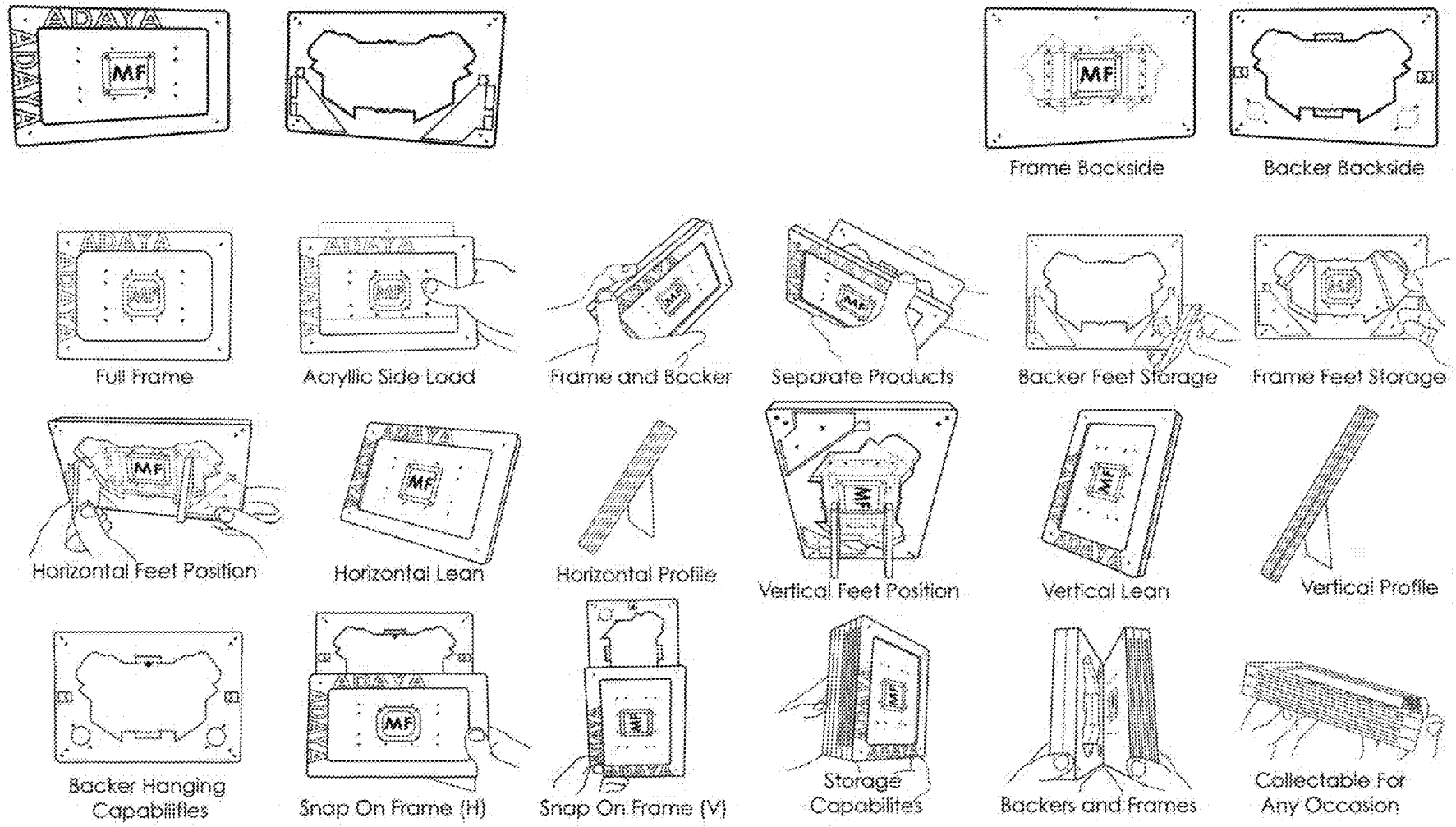
FIG. 6 depicts a series of modalities for assembly and use of an embodiment of the present invention.

As exemplified in FIG. 6, the frame system of the present invention can be configured in a number of different ways, and multiple frame combinations can be stacked for storage.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the claims that ultimately are allowed upon prosecution of the corresponding non-provisional application will cover such modifications that fall within the scope of the invention.

I claim:

1. A modular flame system comprising:

a face frame component;

a back frame component, wherein said back frame component is configured with a plurality of layers, with at least one layer having a cut-out that, in cooperation with at least one other layer of said back frame component, defines an enclosure; and a foot member;

said face frame component and said back frame component respectively having front and back frame component magnets attached thereto, said front and back frame component magnets being respectively positioned respectively relative to said face frame component and said back frame component for reversibly magnetically attracting and attaching said face frame component and said back frame component;

said foot member and said back frame component respectively having foot attachment foot magnets and foot attachment frame-side magnets, said foot attachment foot magnets and said foot attachment frame-side magnets being positioned respectively relative to said foot member and said back frame component for reversibly magnetically attracting and attaching said foot member and said back frame component.

2. A modular flame system comprising:

a face frame component;

a foot member; and a back frame component, wherein said back frame component is configured with a recess that is sized and shaped for nested reception of said foot member;

said face frame component and said back frame component respectively having front and back frame component magnets attached thereto, said front and back frame component magnets being respectively positioned respectively relative to said face frame component and said back frame component for reversibly magnetically attracting and attaching said face frame component and said back frame component;

said foot member and said back frame component respectively having foot attachment foot magnets and foot attachment frame-side magnets, said foot attachment foot magnets and said foot attachment frame-side magnets being positioned respectively relative to said foot member and said back frame component for reversibly magnetically attracting and attaching said foot member and said back frame component.

3. A modular flame system comprising:

a face frame component;

a foot member; and a back frame component, wherein said back frame component is configured with a plurality of layers, with at least one layer having a cut-out that, in cooperation with at least one other layer of said back frame component, defines an enclosure and wherein said back frame component is further configured with a recess that is sized and shaped for nested reception of said foot member;

said face frame component and said back frame component respectively having front and back frame component magnets attached thereto, said front and back frame component magnets being respectively positioned respectively relative to said face frame component and said back frame component for reversibly magnetically attracting and attaching said face frame component and said back frame component;

said foot member and said back frame component respectively having foot attachment foot magnets and foot attachment frame-side magnets, said foot attachment foot magnets and said foot attachment frame-side magnets being positioned respectively relative to said foot member and said back frame component for reversibly magnetically attracting and attaching said foot member and said back frame component.

* * * * *